US005746855A

United States Patent [19]

Bolles

[11] Patent Number: 5,746,855

[45] Date of Patent: May 5, 1998

[54] METHOD AND APPARATUS FOR AUTOMATIC ARCHIVAL STORAGE OF TISSUE SAMPLE SECTIONS CUT FROM A SAMPLE BLOCK

[75] Inventor: Michael Bolles, Sausalito, Calif.

[73] Assignee: Advanced Pathology Systems, Inc., Mill Valley, Calif.

[21] Appl. No.: 738,976

[22] Filed: Oct. 24, 1996

[51] Int. Cl.[6] ..... B32B 31/00

[52] U.S. Cl. ..... 156/64; 156/267; 156/353; 156/355; 156/361; 156/522; 156/548; 156/552

[58] Field of Search ..... 156/64, 250, 267, 156/350, 353, 355, 361, 510, 522, 548, 552

*Primary Examiner*—Melvyn Andrews
*Assistant Examiner*—Paul M. Rivard
*Attorney, Agent, or Firm*—Larry D. Johnson

[57] ABSTRACT

A method and apparatus for the archival storage of tissue sections which have been cut from a sample block by a microtome blade includes a tape bearing serially-spaced areas of adhesive material, generally the same size as the surface of the tissue sample block. The tape may be delivered from a feed reel by a feed roller mechanism. Between each cut, the tape is advanced to align the adhesive area on the tape with the tissue sample. An application roller presses the adhesive against the sample, the section is cut, and a takeup roller lifts the tape and section away from the blade. The tape may then be wound onto a takeup reel for archival storage. The entire process may be automated, including the operation of a transport mechanism to move the apparatus away from the tissue sample during microscopic imaging.

14 Claims, 2 Drawing Sheets

METHOD AND APPARATUS FOR AUTOMATIC ARCHIVAL STORAGE OF TISSUE SAMPLE SECTIONS CUT FROM A SAMPLE BLOCK

BACKGROUND OF THE INVENTION

1. Field of the Invention

The present invention relates generally to optical microscopy and methods for sectioning tissue samples, and more specifically to an improved method and apparatus for the archival storage of tissue sections that have been cut from a sample block.

2. Description of the Prior Art

Historically, small tissue samples have been prepared for microscopic viewing by first encasing the tissue sample into a block of paraffin or plastic, after which the encased sample is sliced into very thin sections on a device called a microtome. A cut section is then placed on a microscope slide where it is chemically processed for viewing, and then stored after viewing. This process requires a skilled operator and is very time consuming, especially if there are more than a few sections to be viewed. After the required number of sections are generated, the remaining tissue sample is generally discarded.

Recent advancements in the digital imaging of tissue sample sections have necessitated a change in this traditional procedure. In devices such as the Surface Imaging Microscope (SIM) and the Planar Sectioning Microscope, the tissue sample is viewed while it is still mounted on the microtome. As each new section is cut, the microscope views the newly exposed surface of the tissue while it is still encased in the sample block. In order to build up a three-dimensional digital reconstruction of the tissue sample, section by section, the entire sample must be sliced. This can result in a large number of tissue sections, for example, on the order of thousands of separate sections per sample.

With this large number of sections it is of course desirable to automate the image capture and sectioning process. Since each section has been imaged prior to it being sliced off of the tissue sample, it is no longer needed for imaging purposes, and may even be discarded. This can easily be accomplished automatically with a suction device such as a small vacuum cleaner.

However, it is often desirable that all or a certain percentage of the cut sections be saved for archival storage purposes. The inventive method and apparatus described herein addresses this requirement.

Typically, when a cut section is to be saved and mounted to a microscope slide, it is lifted off of the microtome blade and floated on a liquid to unwrinkle the section, stretch it out and make it flat. The cut section is then transferred to the microscope slide by placing the slide into the liquid and under the section, and lifting the section out of the liquid with the slide. This procedure does not lend itself very well to automation.

SUMMARY OF THE INVENTION

The present invention provides an improved method and apparatus for the archival storage of tissue sections which have been cut from a sample block by a microtome blade. A tissue section may be processed by applying a plastic film with an adhesive surface (such as adhesive tape) to the face of the tissue sample before the section is cut off from the sample block. As the microtome slices the section off of the tissue block, the adhesive tape (with the section intact) is gently lifted from the surface of the microtome blade, thereby retaining the section on the adhesive. The adhesive tape must be lifted with just the right timing and tension in order to retain the cut section on the tape, and without allowing the tape itself to get caught in the microtome blade. It is the automation of this procedure which is performed by the invention described herein.

The section thus lifted can be subsequently transferred to a microscope slide which has been prepared with a stronger adhesive material. For example, the adhesive on the slide may be catalyzed by ultra-violet light, after which the adhesive tape may be carefully peeled off of the mounted sample.

The inventive apparatus includes a section-storing tape bearing serially-spaced areas of adhesive material, these adhesive areas being generally the same size as the surface of the tissue sample block. The tape may be delivered from a feed reel by a feed roller mechanism. Between each cut of the microtome, the tape is sequentially advanced to align and register the adhesive area on the tape with the tissue sample. An application roller presses the adhesive against the sample, the section is cut, and a takeup roller lifts the tape and section away from the microtome blade. The tape may then be wound onto a takeup reel for archival storage.

The entire process may be automated, including the operation of a transport mechanism to move the apparatus away from the tissue sample for microscopic imaging. In addition, the adhesive tape may include the capacity for data storage, such as by inclusion of a recordable magnetic oxide layer or other material on the tape.

DETAILED DESCRIPTION OF A PREFERRED EMBODIMENT

Figure 1:
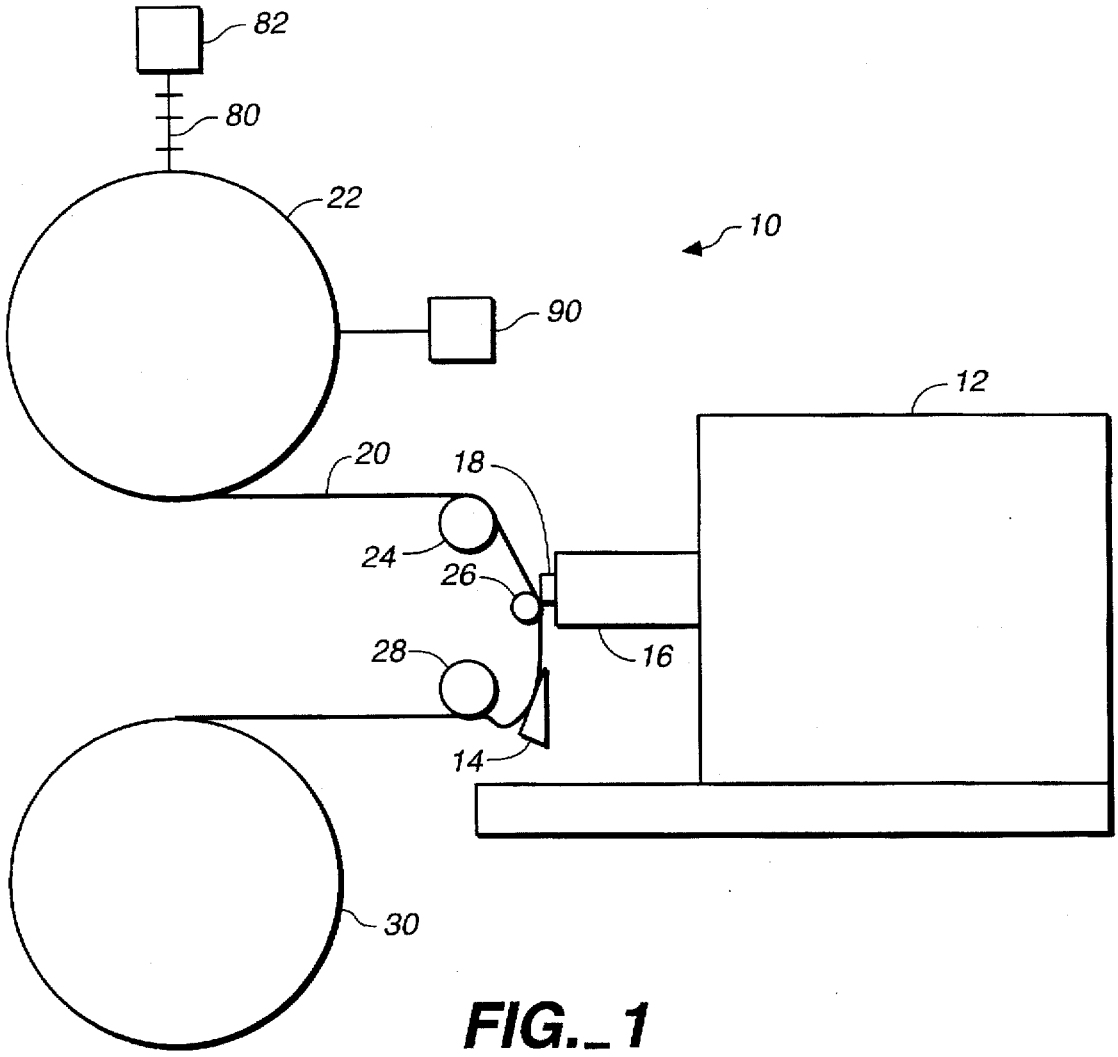
FIG. 1 is a schematic view of the inventive apparatus for the archival storage of tissue sections cut from a sample block, illustrating a microtome and blade, sample holder, and tissue sample block; with the storage tape of this invention supplied from a feed reel, past a feed roller to an application roller adjacent the tissue sample block and microtome blade, to a takeup roller, and ultimately to a takeup reel for storage.

FIG. 1 is a schematic view of an apparatus 10 for the archival storage of tissue sections cut from a sample block of this invention, illustrating a microtome 12 and blade 14, sample holder 16, and tissue sample block 18, all as well known in the art. The inventive storage tape 20 is supplied from a feed reel 22, past a feed roller 24 to an application roller 26 adjacent the tissue sample block 18 and microtome blade 14, to a takeup roller 28, and ultimately to a takeup reel 30 for storage.

Because a large number of sections are to be captured and stored, the tape 20 is supplied in a continuous roll from the feed reel 22, and then stored by rolling the captured sections up into a storage roll on the takeup reel 30. Since each section may be on the order of ½ inch in length, and allowing ½ inch of spacing between each section, the roll of tape may need to be about 85 feet long per 1000 sections of capacity. Furthermore, since each section may be about ¼ inch in width, the tape may need to be about ¾ inch to 1 ½ inches in width to allow for tape handling mechanisms on each side of the section.

The most difficult part of the section capture process occurs at the moment at which the tissue section is cleaved from the tissue sample block 18 by the microtome blade 14. The tape's adhesive has a tendency to stick to the blade, and ruin the cut or become trapped in the blade. To circumvent this problem the inventive tape has an adhesive surface only in the specific area in contact with the tissue sample block, and the tape surrounding the sample has no adhesive.

Figure 2:
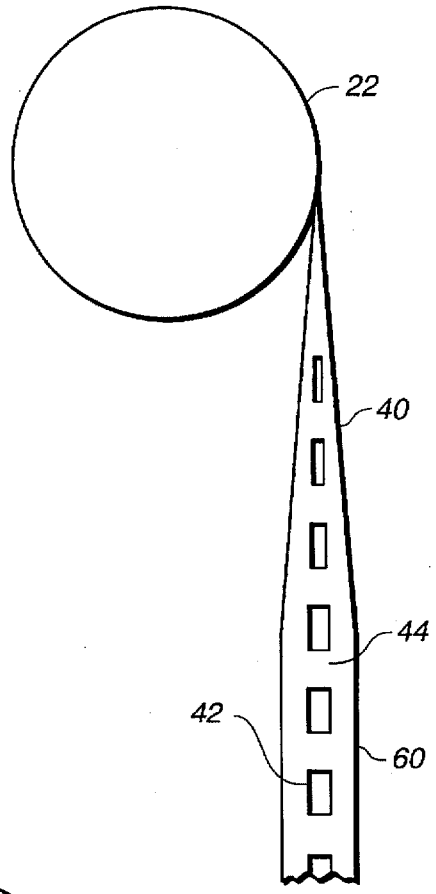
FIG. 2 is a schematic view of a first, integral-adhesive embodiment of the storage tape of this invention.

FIG. 2 is a schematic view of a first, integral-adhesive embodiment 40 of the storage tape of this invention. This tape 40 has intermittent, serially-spaced areas of adhesive 42 which are generally (and preferably precisely) the same size as the surface of the tissue sample block. The areas of adhesive are spaced a known distance apart, such that the tape is advanced exactly this amount between each cut. The areas of adhesive 42 may be lightly color tinted (or otherwise rendered visually distinguishable relative to the non-adhesive remainder of the tape 44) in order to facilitate the initial line-up of the tape to the sample block.

Figure 3:
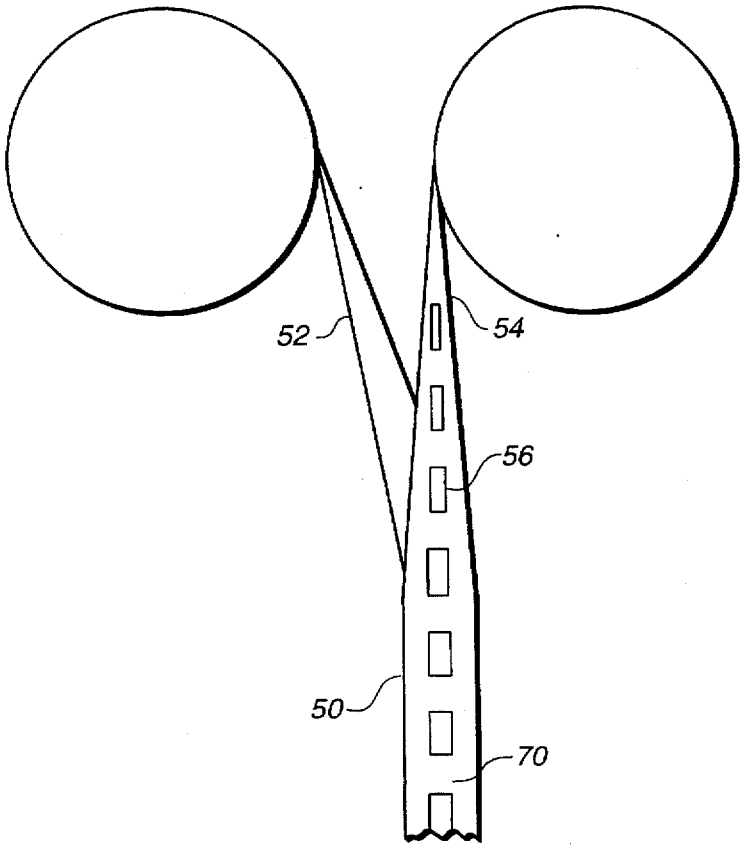
FIG. 3 is a schematic view of a second, masked-adhesive embodiment of the storage tape of this invention.

FIG. 3 is a schematic view of a second, masked-adhesive embodiment 50 of the storage tape of this invention. This embodiment utilizes a standard roll of tape 52 with adhesive over the entire surface in combination with a specially manufactured protection tape 54. In this embodiment, the adhesive tape 52 is protected from the microtome blade by sandwiching it, either during or prior to the section capture, with a specially manufactured roll of non-adhesive tape 54 that has been cut out with open areas 56 precisely the same size as the surface of the tissue sample block. As before, the cut out areas 56 are spaced a known distance apart such that the tape may be advanced exactly this amount between each section. In this embodiment, the tape 54 with the cut outs may be tinted (or otherwise rendered visually distinguishable relative to the adhesive tape 52) in order to facilitate initial line-up. This protection tape 50 provides an additional benefit in the form of a raised surface around the perimeter of each cut section, thereby offering it some protection from physical damage.

In either case, and referring back to FIG. 1, the tape (or tapes) 20 are pulled off of the feed reel 22 (or reels) by the feed roller 24. The feed reel(s) 22 preferably includes a slip clutch or similar mechanism for drag in order to maintain a constant tension on the tape(s) 20. The feed roller 24 may be a capstan roller driven by a motor and a pinch roller (such as in an audio tape player). Alternatively, the feed roller 24 may be a toothed sprocket roller driven by a motor (such as in a motion picture camera).

The application roller 26 applies a pressure on the tape 20 forcing it in contact with the tissue sample block 18. The sample block is moved adjacent the stationary application roller 26 in order to affix the adhesive on tape 20 to the face of the entire tissue sample block. The tissue section is then cut off of the tissue sample block by the microtome blade 14. As the cut section is separated from the sample block, the takeup roller 28 lifts the tape 20 (now containing the section) away from the microtome blade 14. During this phase of the procedure, the tension on the tape must be slack in order to avoid pulling the tape off of the section before it is completely severed. As with the feed roller, the takeup roller 28 may be a capstan roller, a sprocketed roller, or similar device. In any case, the feed and takeup rollers should not contact the tape 20 in the center area occupied by the adhesive surface. The tape is then wound onto the takeup reel 30 which is preferably motorized. When a tissue sample is completely sectioned or when a takeup reel is completely full, the reel is removed for storage.

Because the Z axis or focus position of the tissue sample must remain the same from one section to the next for proper imaging, the application roller 26 should apply pressure to the face of the sample block even when that particular section is not intended to be saved. Toward that effect, the tape should be advanced to an area without any adhesive, i.e., an area which lies between two areas of adhesive. The tape will then remain at that position for each and every section until such time as a section is to be saved (the non-saved sections being discarded in the traditional manner). At that time the tape will advance to the next area which has adhesive.

Additionally, the captured sections may be further protected by the application of an additional layer of adhesive tape to the first tape, such that the captured sections are laminated between the two layers of tape. Ideally this step would occur as the tape(s) are being wound onto the takeup reel 30.

The tape may also have information storage capability, such as in the form of a magnetic oxide layer 60 along either side, or a transparent magnetic oxide layer 70 over all or a portion of the tape. This layer may be utilized to magnetically record analog or digital information such as the tissue sample type and number, the sectioning thickness and number, and any other useful information. This data may be utilized during a review of archived material to automatically search for a particular section.

Since both the Surface Imaging Microscope and the Planar Sectioning Microscope view the tissue sample as it is still contained in the sample block on the microtome, the section saving apparatus must be moved out of the way during imaging. Toward this end the section saving device may ride upon a track or linear rails 80. After a section has been saved, the entire section saver is translated away from the optical axis of the microscope. This may be accomplished through the use of a manual or motorized transport mechanism 82. This mechanism may take the form of a motor which rotates a leadscrew. The rotation of the leadscrew draws the section saver away from the microtome, or pushes it back into position. In order for this sideways motion to occur, the application roller 26 must retract slightly to withdraw from the face of the tissue sample. This retraction is also preferably motorized.

The entire operation of the section saver may be controlled and coordinated by a process control software program via computer control such as controller 90. The software activates each of the motors within the section saver to the proper distance and in the proper order. This software program may reside in and be under the control of the same computer that controls the microscope and microtome.

The invention described here is capable of storing a large number of cut sections as they are sliced off of the tissue sample block by the microtome blade. It is also capable of storing any percentage of the cut sections up to 100%. The sections may be captured in either an ordered pattern such as every tenth section, or a random pattern.

While this invention has been described in connection with preferred embodiments thereof, it is obvious that modifications and changes therein may be made by those skilled in the art to which it pertains without departing from the spirit and scope of the invention. Accordingly, the scope of this invention is to be limited only by the appended claims and equivalents.

What is claimed as invention is:

1. An apparatus for the archival storage of tissue sample sections which have been cut by a microtome blade from a tissue sample block having an exposed surface, said apparatus comprising:

a section-storing tape having a surface bearing serially-spaced adhesive areas separated by non-adhesive areas, said adhesive areas being generally the same size as the tissue sample block exposed surface; and means for delivering said section-storing tape adjacent the tissue sample block so that one of said adhesive areas is aligned with the tissue sample block exposed surface.

2. The apparatus for the archival storage of tissue sample sections of claim 1 wherein said delivery means includes a feed roller mechanism for delivering said section-storing tape to said tissue sample block from a quantity of tape in a feed reel.

3. The apparatus for the archival storage of tissue sample sections of claim 1 wherein said delivery means includes an application roller adapted to press said adhesive area against the tissue sample block exposed surface.

4. The apparatus for the archival storage of tissue sample sections of claim 3 wherein said application roller is adapted to press a non-adhesive area of said section-storing tape against the tissue sample block exposed surface when a tissue sample section is not being saved for archival storage.

5. The apparatus for the archival storage of tissue sample sections of claim 1 wherein said delivery means includes a takeup roller adapted to lift said section-storing tape away from the microtome blade.

6. The apparatus for the archival storage of tissue sample sections of claim 1 wherein said delivery means includes a takeup reel for archival storage of said section-storing tape.

7. The apparatus for the archival storage of tissue sample sections of claim 1 further including a transport mechanism to move said apparatus away from the tissue sample for microscopic imaging.

8. The apparatus for the archival storage of tissue sample sections of claim 1 wherein said section-storing tape includes means for data storage.

9. The apparatus for the archival storage of tissue sample sections of claim 1 further including control means for coordinating serial delivery of said section-storing tape adhesive areas to the tissue sample block exposed surface between successive cuts by the microtome blade.

10. The apparatus for the archival storage of tissue sample sections of claim 9 wherein said control means comprises computer control.

11. A method for automatic archival storage of tissue sample sections cut by a microtome blade from a tissue sample block having an exposed surface, said method comprising the steps of:

providing a length of section-storing tape having a surface bearing serially-spaced adhesive areas separated by non-adhesive areas, said adhesive areas being generally the same size as the tissue sample block exposed surface;

placing one of said adhesive areas onto the tissue sample block exposed surface;

cutting a section from the tissue sample block with the microtome blade; and lifting said section-storing tape with the section cut from said tissue sample block away from the microtome blade.

12. The method for the archival storage of tissue sample sections of claim 11 further including the step of moving said section-storing tape away from the tissue sample block for microscopic imaging.

13. The method for the archival storage of tissue sample sections of claim 11 further including the step of pressing a non-adhesive area of said section-storing tape against the tissue sample block exposed surface when a tissue sample section is not being saved for archival storage.

14. The method for the archival storage of tissue sample sections of claim 11 further including the step of controlling the serial delivery of said section-storing tape adhesive areas to the tissue sample block exposed surface between successive cuts by the microtome blade by computer control.

* * * * *